United States Patent [19]

Koch et al.

[11] 4,014,203

[45] Mar. 29, 1977

[54] EJECTOR MECHANISM FOR EJECTING PRESSED PARTS FROM THE BOTTOM DIE OF PRESS

[75] Inventors: Friedrich-Karl Koch; Hugo Schneiders, both of Krefeld, Germany

[73] Assignee: Peltzer & Ehlers, Krefeld, Germany

[22] Filed: June 20, 1975

[21] Appl. No.: 588,665

[52] U.S. Cl. ..... 72/427; 10/11 E

[51] Int. Cl.[2] ..... B21D 45/00

[58] Field of Search ..... 10/11 R, 11 E; 72/328, 72/344, 345, 346, 427

[56] References Cited

UNITED STATES PATENTS

| | | | |
|---|---|---|---|
| 1,592,060 | 7/1926 | Wilcox | 10/11 E |
| 2,547,304 | 4/1951 | Broscomb | 10/11 E |
| 3,158,047 | 11/1964 | Carlson | 10/11 R |
| 3,238,761 | 3/1966 | Hoyt | 10/11 R |
| 3,619,835 | 11/1971 | Nebendorf | 10/11 E |
| 3,820,376 | 6/1974 | Koch et al. | 72/427 |

FOREIGN PATENTS OR APPLICATIONS

| | | | |
|---|---|---|---|
| 1,079,300 | 8/1967 | United Kingdom | 10/11 E |

*Primary Examiner*—C.W. Lanham
*Assistant Examiner*—E. M. Combs
*Attorney, Agent, or Firm*—Herbert E. Kidder

[57] ABSTRACT

An axially movable ejector rod has one end abutting against one arm of a pivoted ejector lever. A second arm on the ejector lever has a generally radially extending plane surface that is contacted by a roller carried at the end of a lever arm pivoted on a supporting slide. The roller also rides on a second plane surface on one arm of an intermediate lever, the other arm of which is connected to a link. This link is reciprocated by a rotating cam, causing the intermediate lever to rock and pressing its plane surface against the roller. The roller, in turn, presses against the arm of the ejector lever and causes the latter to rock. As the intermediate lever and ejector lever rock on their respective pivots, the roller rolls along the respective plane surfaces. The supporting slide carrying the lever arm with its roller is movable in the direction to shift the roller along the two plane surfaces. In one direction of travel, the roller approaches closer to the pivot center of the intermediate lever and at the same time moves more distant from the pivot center of the ejector lever, thereby changing the effective moment arms of the two levers. An adjustment screw is provided to adjust the position of the supporting slide.

3 Claims, 1 Drawing Figure

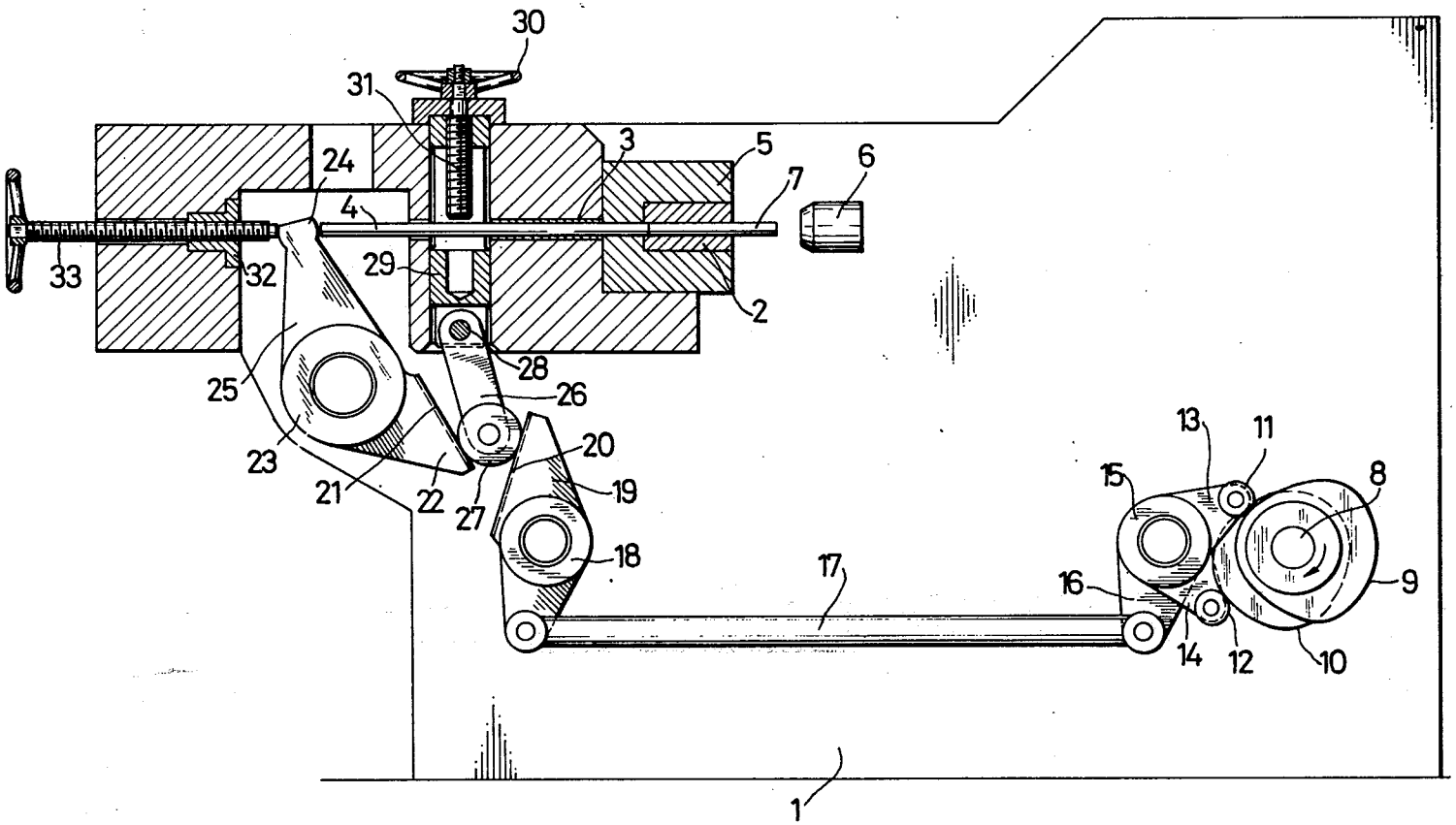
1
2
3
4
5
6
7
8
9
10
11
12
13
14
15
16
17
18
19
20
21
22
23
24
25
26
27
28
29
30
31
32
33

EJECTOR MECHANISM FOR EJECTING PRESSED PARTS FROM THE BOTTOM DIE OF PRESS

The present invention pertains to an ejector mechanism for ejecting pressed parts, particularly in machines for the manufacture of screws with an ejector bolt actuated by a linkage, as well as an adjusting mechanism for its stroke adjustment. Such ejectors serve to eject the finished product from the rear out of the press.

Ejector mechanisms are known where the rotatably mounted ejector lever is driven by a crank drive with constant stroke together with an adjustable intermediate lever for the displacement of the ejector bolt.

This intermediate lever is in the danger zone of the machine and can only be adjusted when the press stands still. A fine adjustment with the machine running is not possible.

The invention is thus based on the problem of designing an ejector mechanism so that the ejector stroke can be adjusted in a simple manner during the operation of the machine.

This problem is solved according to the invention in this way. The adjusting mechanism has a transmission element which is arranged on a rocker arm, etc., with a displaceably mounted suspension bearing and is arranged between two levers whose transmission surfaces are not parallel to each other in the retracted deadcenter position of the ejector bolt.

According to one feature of the invention, it is suggested that the transmission element have at least two rollers. Alternately it is provided that the transmission element have at least two slides.

Furthermore it is provided according to the invention that the suspension bearing for the rocker arm be secured on an adjusting spindle. By turning the adjusting spindle it is possible to adjust the position of the transmission element relative to the transmission surfaces so that the transmission ratio between the two levers is infinitely variable.

According to another feature of the invention is is suggested that the transmission surfaces extend parallel to each other in the extended dead-center position. This measure serves to make sure that the extended deadcenter position of the ejector bolt remains always the same, despite adjustment of the transmission element.

The transmission surfaces are preferably plane, because this has advantages in the manufacture.

According to another feature of the invention, it is provided that the ejector have an adjustable abutment which blocks the lever actuating the ejector bolt in the extended deadcenter position of the ejector bolt against the direction of rotation of the ejector. In this way the force acting during the pressing directly on the ejector bolt is transmitted to the machine frame, so that the entire linkage is kept free of this stress and can therefore be made much lighter. In a further development of the invention, it is suggested that the abutment be designed as an axially adjustable pressure spindle.

Finally it is provided that the pressure spindle is arranged coaxially with the ejector bolt. With this measure the pressure action on the ejector bolt is transmitted to the machine frame without stressing the lever and its bearing.

The invention is illustrated in the drawing on the basis of an embodiment.

In the machine frame 1 of a press for transforming bolts into screws, etc., there is arranged an ejector mechanism for ejecting the finished pressed part from the bottom die 2. To this end an ejector bolt 4 is mounted in a sleeve 3 in the machine frame 1, which protrudes from the rear into the bottom die mounted in a block rigidly connected with the machine frame 1. In the retracted deadcenter position of the ejector bolt 4 shown here, the latter serves as a rear stop for the pressed part 7 not yet deformed by the press plunger 6 and thus determines the length of the finished pressed part. To make sure that screws, etc., can be produced in different lengths with the same cross section of the bottom die 2, the location of the retracted deadcenter position of the ejector bolt 4 relative to the bottom die 2 can be varied over an adjusting mechanism in the linkage of the ejector.

This linkage for actuating the ejector bolt 4 is driven by two cam disks 9, 10 arranged tandem on a uniformly rotating drive shaft 8, on which ride one of two rollers 11, 12, which are mounted on two lever arms 13, 14 of a three-arm lever 15 arranged in an angle to each other. By corresponding shaping of the cam disks 9, 10, a guided reciprocating movement of the three-arm lever 15 with a constant amplitude is thus produced.

The third lever arm 16 of the three-arm lever 15 drives by means of a coupling rod 17, an intermediate lever 18 which has on its upper lever arm 19 a plane transmission surface 20. The latter forms in the retracted dead-center position shown here an acute angle with the plane transmission surfaces 21 on the lower lever arm 22 of the ejector lever 23, which actuates the ejector bolt 4 directly from its rear side, with head piece 24, rounded off on both sides, on its upper lever arm 25.

Between the two transmission surfaces 20 and 21 is suspended a transmission element in the form of two side-by-side rollers 27 (only one of which can be seen in the drawing), which are suspended like a pendulum on a rocker arm 26. One of the two rollers 27 rides on the flat plane surface 20 of lever 19, and the other roller rides on the flat plane surface 21 of lever 22. Thus, the rollers 27 can roll off freely on their respective transmission surfaces 20, 21 and a low resistance movement of the linkage is thus obtained. The rocker arm 26 is articulated with its suspension bearing 28 on axially movable slide 29 whose position can be adjusted by turning the hand wheel 20 of the spindle 31.

The ejector lever 23 is pressed in the represented retracted deadcenter position of the ejector bolt 4 with the side of the rounded head piece 24 opposite the latter under initial stress against a pressure spindle 33 guided in the threaded bushing 32 coaxially to the ejector bolt 4. With this pressure spindle 33, the pressure acting during the pressing on the ejector bolt 4 is transmitted directly into the machine frame 1, without the ejector lever 23 or other parts of the linkage being stressed in any way. For this reason these parts of the linkage only hve to be laid out for the much lower force required for the ejection.

If the length of the pressed part to be produced is to be reduced, the ejector bolt 4 must protrude in the retracted deadcenter position further from the rear into the bottom of die 2. To this end the ejector lever 23 and thus the ejector bolt 4 are moved in the direction of ejection by turning the pressure spindle 33 until the required new retracted deadcenter position is reached. In this way the position of the transmission surface 21 on the ejector lever 23 relative to the transmission surface 20 on the intermediate lever 18 has so changed, however, that at least one roller 27 no longer has contact with its associated transmission surface 20 or 21, which is undesirable, due to the jolts appearing during the operation. For this reason, the transmission element is lowered so far over the adjusting spindle 31, whose hand wheel 30 is preferably arranged outside the danger zone of the press, that both rollers 27 have contact again with their associated transmission surfaces 20 and 21, so that a jolt-free transmission of the movement within the linkage is ensured at any time. It is imaginable that both adjustments are coupled with one another, so that it is only necessary to operate one of the spindles.

Since the position of the opening pointing to the press plunger 6 relative to the machine frame 1 does not change during the adjustment process, it is not necessary to change the location of the deadcenter position of the ejector bolt 4. The ejector bolt 4 and the ejector lever 23 with its transmission surface 21 thus always reach the same end position after passing through the stroke in the direction of ejection despite the change in the retracted deadcenter position. Since the position of the transmission surface 20 on the intermediate lever 18 is always the same in this end position, due to the cyclic guided control over the two cam disks 9, 10, a realized or still-to-be-realized displacement of the suspension bearing 28 over the adjusting spindle 31 does not have an effect on this end position only if the transmission surfaces 20, 21 are parallel to each other in a distance corresponding to the roller diameter, as it is provided according to the invention.

The above mentioned ejector mechanism permits a simple adjustment of ejection stroke, while maintaining the end position, and thus an infinitely variable adjustment to the required length of the pressed part during the operation by means of hand wheels, which are arranged outside the danger zone of the press and which can be reached from the operating platform. By a corresponding association of the transmission surfaces 20 and 21 to one another and to the diameter of the rollers 27, an adjustment range from zero to the maximum stroke can be achieved.

What we claim is:

1. An ejector mechanism for ejecting pressed parts from the die of a machine having a frame, said mechanism comprising, in combination:

an ejector bolt slidable within the frame of the machine between an initial position and an eject position;

an ejector lever pivotally mounted on the machine frame and having a first arm that engages a rear end of said ejector bolt so as to cause the latter to slide from said initial position to said eject position when the lever is rocked in one direction, said ejector lever having a second arm with a generally radially extending planar surface provided thereon;

an intermediate lever pivotally mounted on the machine frame adjacent said ejector lever and rotatable within substantially the same plane as the ejector lever, said intermediate lever having a first arm extending alongside said second arm of the ejector lever and having a generally radially extending planar surface provided thereon on the side facing said planar surface on said second arm of the ejector lever, the planar surface on said first arm of said intermediate lever converging at an acute angle with the planar surface on said second arm of said ejector lever when said ejector bolt is in said initial position;

said intermediate lever also having a second arm projecting from the pivot axis;

a coupling rod connected to one end to said second arm of said intermediate lever;

cam means for reciprocating said coupling rod;

a slide member slidably mounted on the machine frame for movement toward or away from the converging planar surfaces;

roller means swingably suspended from said slide member, said roller means riding on both of said planar surfaces and serving to provide a movable pressure contact point between said first arm of said intermediate lever and said second arm of said ejector lever;

adjustable means engaging a back side of said first arm of the ejector lever; and means on the frame of the machine for slidably adjusting the position of said slide member, thereby moving said roller means along said planar surfaces so as to increase the effective moment arm of one of the levers while decreasing the effective moment arm of the other lever.

2. The invention as set forth in claim 1, wherein said roller means are journaled on one end of a link, the other end of which is swingably connected to said slide member; and said means for adjusting the position of the slide member comprises a screw rotatable with respect to the machine frame and having threaded connection to the slide member.

3. The invention as set forth in claim 1, wherein said adjustable means engaging the back side of said first arm of the ejector lever comprises a screw, one end of which engages the ejector lever and the other end projects from the machine frame and has a hand wheel fixed thereto.

* * * * *